United States Patent [19]

Jacobson

[11] 4,013,219

[45] Mar. 22, 1977

[54] MANUALLY ACTUATED, SELF-EXPIRING, TEMPORARY OVERRIDE APPARATUS AND METHOD FOR THERMOSTATIC SYSTEM

[76] Inventor: James W. Jacobson, 17643 NE. 30th Place, Redmond, Wash. 98052

[22] Filed: Mar. 15, 1976

[21] Appl. No.: 666,666

[52] U.S. Cl. ..... 236/46 R; 337/301; 200/38 A

[51] Int. Cl.[2] ..... H01H 37/62; F23N 5/20

[58] Field of Search ..... 236/46 R, 46 E, 46 D; 337/301; 62/231, 163; 165/12; 337/334, 115; 219/489; 200/38 A

[56] References Cited

UNITED STATES PATENTS

| | | | |
|---|---|---|---|
| 2,220,808 | 11/1940 | Williamson | 236/46 |
| 2,371,998 | 3/1945 | Houghton et al. | 337/304 |
| 2,402,787 | 6/1946 | Stickel | 219/489 X |
| 2,486,873 | 11/1949 | Pearce | 219/489 |
| 3,203,258 | 8/1965 | Grayson | 74/3.5 |

*Primary Examiner*—William E. Wayner
*Attorney, Agent, or Firm*—Christensen, O'Connor, Garrison & Havelka

[57] ABSTRACT

A standard thermostat control unit, such as used in residential heating systems, is modified to include a manually actuated, electro-mechanical timer that includes a switch connected across the unit's thermostatically operated contacts, such that actuation of the timer produces a temporary, self-expiring, operating mode in which the normal thermostatic regulation of the furnace is overridden and the furnace is held "on" for the brief duration of the timer interval. The modified unit may be used in lieu of the standard unit as an energy and cost saving device in places such as in a vacant house, waiting to be sold or rented, with the unit preset at a minimum, thermostatically regulated temperature level. To briefly increase the temperature in the house to a comfort level, for such temporary occupancy as a realtor showing the house to prospective purchasers, the timer is manually actuated to commence a short timing interval, such as five minutes, during which the furnace is turned on and maintained so for the timing interval, and at the expiration thereof the unit automatically reverts to the energy saving, thermostatically regulated mode at the lower temperature.

2 Claims, 4 Drawing Figures

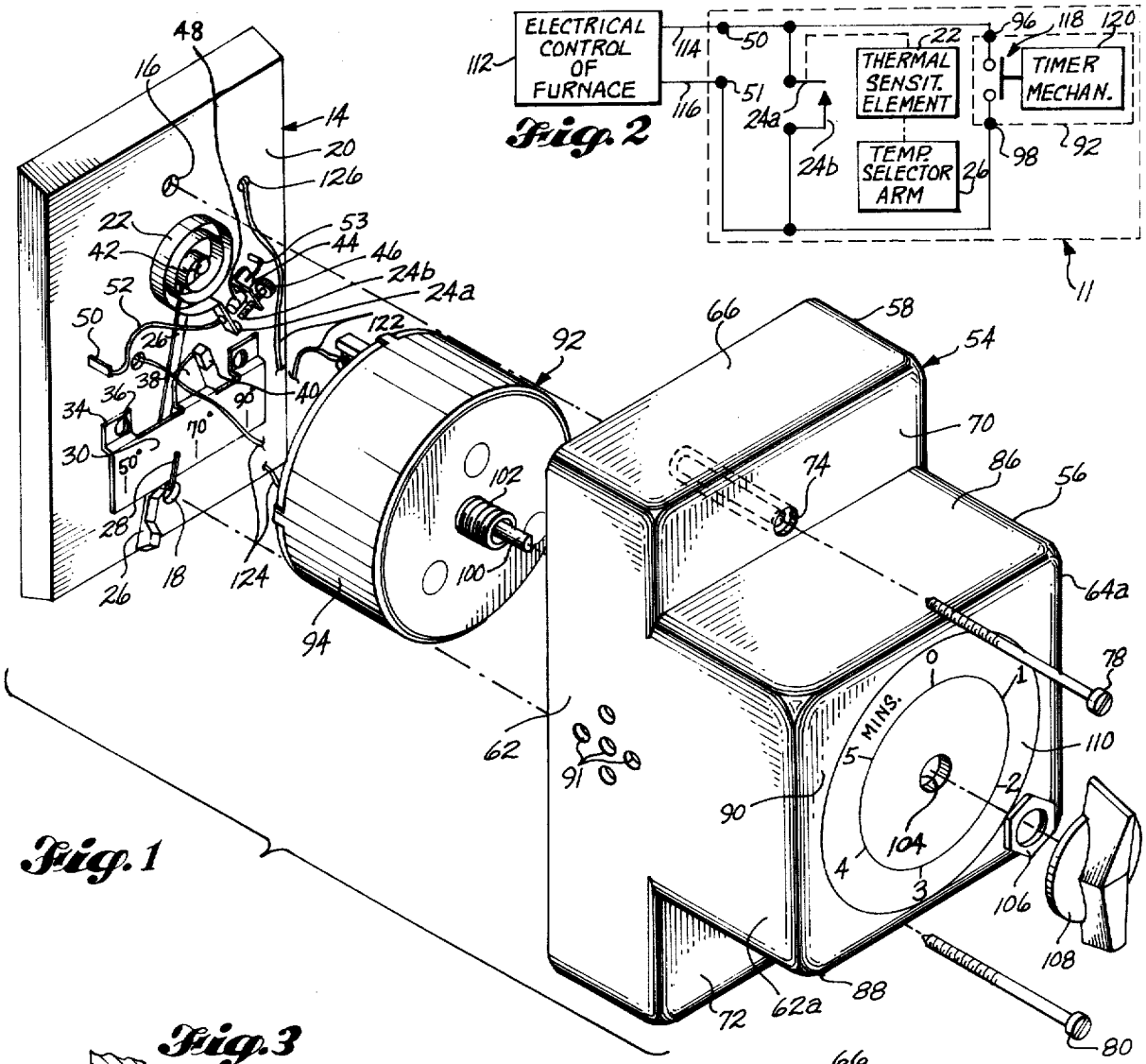
Fig. 2
Fig. 1
Fig. 3
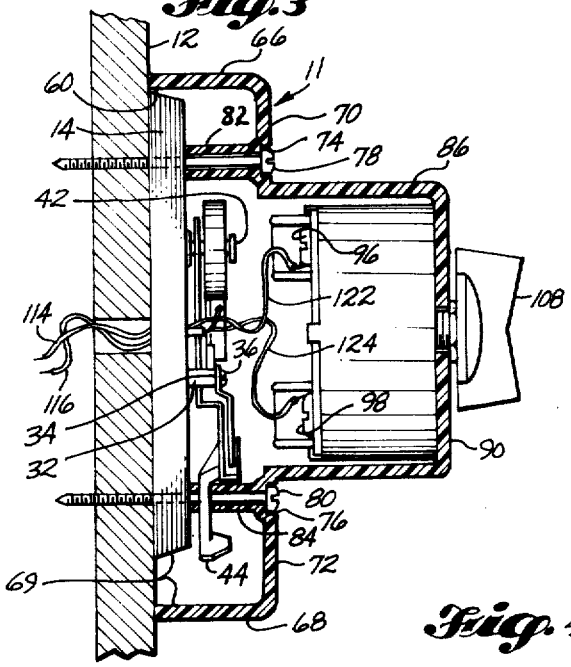
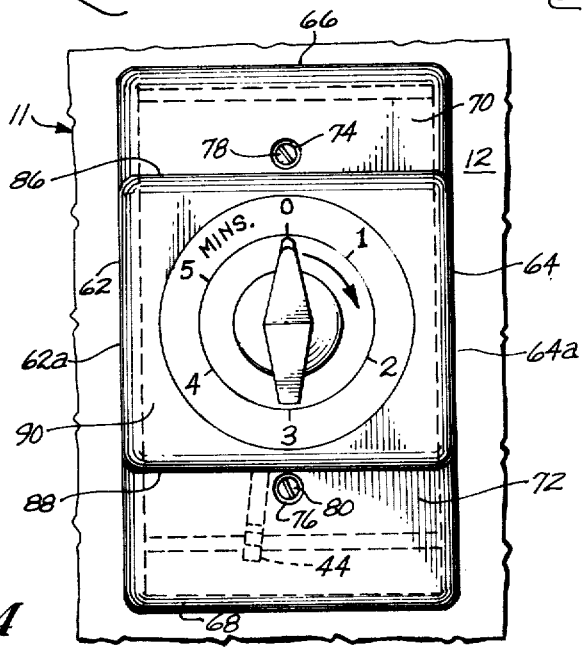
Fig. 4

MANUALLY ACTUATED, SELF-EXPIRING, TEMPORARY OVERRIDE APPARATUS AND METHOD FOR THERMOSTATIC SYSTEM

BACKGROUND

In general the present invention relates to thermostatic systems and more particularly to heating and/or cooling systems that are turned "on" and "off" by electrical contacts operated by a thermal-sensitive element.

Although the present invention has many applications, it is particularly useful as an energy saving device for operating thermostatically controlled furnaces in homes and apartments that are vacant by reason of being held for sale or rent. In colder climates, particularly in the winter, it is desirable to maintain a predetermined minimum temperature within the house or apartment to protect its plumbing system from freezing, and this is usually accomplished by activating the furnace system and setting the standard thermostat control unit to the predetermined minimum temperature. When the premises are occupied for brief periods of time, such as during an inspection by a realtor and/or potential purchasers or renters, it is likely that the thermostat control unit will be turned up to warm the premises to a comfort temperature level, such as 70° F., with the intention of restoring the temperature setting to its minimum level when leaving.

Unfortunately, the control unit many times is not returned to the minimum temperature setting, and the house or apartment may remain vacant for days and even weeks, with the furnace being operated at the higher temperature range, thus causing a great waste of energy and a substantial expense to the owner of the building. For a builder of new houses, the maintains an inventory of vacant, "for sale" houses, the monthly expense due to unnecessary heating, becomes exorbitant, especially in view of the rising cost of electricity and fuel.

Although the present invention is described herein in conjunction with a thermostatically-controlled furnace, it will be appreciated that the same principles of operation apply to a thermostatically controlled air-conditioning or cooling system for homes, apartments and other buildings. Thus, the present invention is useful in combination with these latter systems also.

It is therefore an object of the present invention to provide method and apparatus for saving energy (and the correlative cost thereof) in operating thermostatically regulated heating or cooling systems which for the most part are to be operated at a temperature level that consumes minimal energy, and which occasionally are to be operated for brief intervals at a temperature which requires a greater consumption of energy.

Another object is to provide method and apparatus for use in conjunction with a conventional thermostatically regulated home heating/cooling system in which the standard thermostat control unit can be temporarily replaced by a modified control unit during vacancy of the building which modified unit has a normal operating mode for maintaining the temperature of the vacant building at a predetermined level requiring only minimal energy consumption, and which has a different, manually actuated mode, to be used when the premises are occupied for a brief period, for changing the temperature level to a range that is comfortable to the occupants but consumes more energy, where the last named mode is self-expiring, to cause the system to automatically revert to the normal operating mode to insure that the system is not neglectfully left in its higher energy consuming state.

A further object of the present invention is to provide a low cost, easily manufactured, modified thermostat control unit, that may be substituted for a standard control unit in a vacant house or apartment that is for sale or rent, to enable the setting of the device at a temperature range that minimizes the on operation of the heating or cooling system, and which enables the system to be manually changed to a different temperature range (increased in case of a heating system and decreased in the case of a cooling or air conditioning system) for the duration of a brief period of inspection of the premises by prospective renters or buyers, and which automatically reverts to the first mentioned temperature range after a predetermined, short interval.

SUMMARY OF THE INVENTION

Briefly, the above objects are achieved by a thermostat control unit that incorporates a manually actuated timer and an electrical switch operated by such timer together with the components of a standard thermostat control unit to provide two different modes of operation. In a first and normal mode, the time is unactuated, and the heating or cooling system is automatically controlled in the usual manner so as to be cycled on and off to produce a range of temperatures determined by a temperature range selector provided on the control unit. In the case of a thermostatically regulated furnace, the temperature may be set to a level such as 40°, 50° or 60° for protecting the plumbing of a vacant house and/or to maintain the temperature at a high enough level to permit the house to be warmed up within a brief interval. Upon entering the premises, the timer can be manually actuated to dispose the control unit in a second mode, in which the timer operated switch electrically overrides the thermostat contacts and turns the heating or cooling system on and maintains it on for the duration of the timer interval. The timer, such as a spring recoil timer, is selected to provide a maximum interval of about 5 to 10 minutes for the override mode, at the end of which the override mode self-expires and the switch controlled by the timer is deactivated to restore the control of the system to the thermostat contacts. The premises are thus "warmed up" (furnace) or "cooled off" (air conditioner) for the brief duration of occupancy, whereafter the control unit insures that the system reverts to the normal operating mode in order to prevent the waste of energy.

In a preferred form of the invention as described herein, the timer and the electrical switch operated thereby, are provided by an electro-mechanical timer that is mounted inside a casing, with a control element of the timer protruding exteriorally of the casing for manual actuation. The casing fits over a standard base plate that carries the conventional thermostat components, and the assembled unit including the base plate, casing and timer may be mounted to a wall or other supporting surface that has been provided for, and will subsequently be used for the standard unit (when the building is occupied) and is connected to the furnace control wires available thereat.

To avoid any resetting with the position of the temperature selector, of the modified unit, that might be made by visitors during inspection of the premises, the casing is shaped to cover the temperature selector and thereby render it inaccessible when the unit is fastened to the wall. During installation, access to the selector is provided by a rear opening between the casing and base plate that is exposed, for temperature adjustment prior to the attachment of the unit to the wall.

These and further features, objects and advantages of the invention will become apparent to those skilled in the art from the following detailed description and appended drawings.

BRIEF DESCRIPTION OF THE DRAWINGS

FIG. 1 is an exploded view of the modified thermostat control unit in accordance with the apparatus of the present invention.

FIG. 2 is a schematic diagram of the thermal, mechanical and electrical components of the invention shown in combination with an electrical control of a furnace.

FIG. 3 is a vertical sectional view of the assembled control unit of FIG. 1 when mounted to a supporting surface.

FIG. 4 is a front elevation view of the mounted unit of FIG. 3.

DETAILED DESCRIPTION

In accordance with the apparatus of the present invention, a modified thermostat control unit 11 (the unassembled components of which are shown in FIG. 1) is constructed so that it may be mounted on a supporting surface such as wall 12, in place of and in the same manner as a standard thermostat control unit (not shown) of the type typically found in residential heating and/or cooling systems. It is intended that unit 11 be installed while the premises are vacant, such as a newly constructed, unoccupied house, for controlling the furnace and/or air conditioner in a manner described more fully herein, and subsequently removed and replaced by the standard control unit when the house becomes permanently occupied.

With reference to FIG. 1, unit 11 includes a base plate 14, that is preferably the same base plate used in the standard control unit, and is made of a plastic material molded in the shape of a generally flat, rectangular plate, elongate in the height dimension, and provided with mounting holes 16 and 18 for attachment to wall 12. The principal components of the standard thermostat are mounted to a front face 20 of plate 14 and here for illustration, include a thermal sensitive element 22, electrical contacts **24*a* and 24*b* which are operated by element 22, and a temperature range selector arm 26 for mechanically, adjustably biasing the position of element 22 and contact 24*a* for setting for temperature or temperature at which the thermostat contacts 24*a* and 24*b* are opened and closed. Arm 26 carries a selector pointer 28 disposed to overlie a temperature scale 30 provided on a front face of a metal panel 30, of rectangular shape, elongate in the width dimension of plate 14. Panel 30 is supported in spaced apart, parallel relationship to face 20 of plate 14, overlying arm 26, by means of studs 32 (shown in FIG. 3) to which a pair of integral tabs 34 of panel 30 are secured by screws 36. Panel 30 also carries a flange 38 extending first inwardly toward face 20 of plate 14 and then upwardly parallel to the plate toward element 22 to form a stop for contact 24*a*. A pad 40 of resiliently compressible material serves to cushion any clockwise recoil movement of contact 24*a* toward flange 38 when a snap action magnet associated with the operation of contacts 24*a* and 24*b* suddenly releases contact 24*a* to allow it to recoil to an open condition, spaced from stationary contact 24*b***.

Element 22 is an elongate bimetallic strip, spirally wound and having its inner end mechanically fastened to an electrically conductive metal stud 42, disposed coaxially with the spiral configuration of element 22. Stud 42 is journaled for rotation in a frictionally braked bearing assembly (not shown) carried by plate 14. An upper end of selector arm 26 has an enlarged apertured end that is keyed to stud 42 for conjoint rotation of stud 42 and element 22 (against the frictional brake tending to maintain stud 42 and element 22 at a fixed angular orientation), by means of manipulating a lower end 44 of arm 26 back and forth. In this manner the position pointer 28 is used to set arm 26 to a desired temperature on the scale provided on panel 30. Once the angular position of stud 42 and the innermost end of spiraled element 22 are set by arm 26, they are frictionally held in the selected position while the coils of element 22 are displaced with respect thereto in response to changes in ambient temperature.

The end of the outermost coil of element 22 forms an armature that carries movable contact **24*a* and moves clockwise as the coils of element 22 unwind in response to increasing temperature and moves counterclockwise as the coils contact or wind-up due to decreasing temperature. Contact 24*b* is fixedly mounted to plate 14 and includes an L-shaped bracket 44 having one leg suitably secured to plate 14 by means such as a rivet, and having a forwardly standing leg mounting an adjustment screw 46 and a permanent magnet 48. Bracket 44 and adjustment screw 46 are electrically conductive with the end of screw 46 providing the fixed contact 24*b*, with screw 46 being threadedly mounted to bracket 44 for factory calibration of the temperature at which contacts 24*a* and 24*b* close. Magnet 48 causes a snap action closing of the contacts when contact 24*a* moves to within a certain threshold proximity to contact 24*b*. A correlative, abrupt release of contact 24*a* occurs when the unwinding of the coils of element 22 exert a force on contact 24*a* that exceeds the holding force of the magnet 48**.

Contact **24*a* is electrically connected to a thermostat terminal 50 by an interconnect wire 52. Terminal 50 is fastened to plate 14 and includes means disposed in a recessed rear face (not shown) of panel 14 for receiving and connecting one of a pair of furnace control wires, while a similar connection is made for the other of such pair of wires to a terminal 51 that is electrically joined to bracket 44 and thus contact 24*b* by an interconnect wire 53**.

Although a thermostat control unit having the foregoing features and construction can be manufactured specifically for the present invention, I prefer to use the base plate and principal components of a commercially available, standard control unit, such as a model number T819D manufactured by and commercially available from Honeywell Inc. of Minneapolis, Minn. The standard unit includes a cover (not shown here) that is complemental to the shape of plate 14 and fits over the front face 20 for housing the components mounted thereon. In such case end 44 of arm 26 is accessible for manual setting through an aperture or cutaway portion on the standard cover in registration with arm 26, and a window is provided on the cover in superposition with the scale on panel 30.

In place of the standard cover, my modified unit is provided with a casing 54, which may be molded from a suitable plastic material to form a compound shape that includes both a rear portion and a front portion, both being of hollow box-like configuration and both opening to the rear. The hollow interior of the front portion 56 of casing 56 opens rearwardly into the hollow interior of the rear portion 58 which in turn defines an opening 60 (FIG. 3) at the rear terminus of sidewalls 62 and 64 and top and bottom walls 66 and 68 respectively. The width, height and depth dimensions of rear casing portion 58 are selected to complement the peripheral dimensions of base plate 14 and the forward extent of the components mounted thereon, so that casing 54 can be mounted over base plate 14 (best shown in FIG. 3), with the terminus of side, top and bottom walls 62, 64, 66 and 68 of the casing flush with the back of plate 14, and with the interior surfaces of sidewall 62 and 64 snugly contacting the exterior sides of plate 14. The height dimension of rear portion 58 between the interior surfaces of top and bottom walls 66 and 68 is selected to exceed the corresponding height dimension of plate 14, to provide a gap 69 between the interior of bottom wall 68 and the bottom of plate 14 (best shown in FIG. 3) for access therethrough to end 44 of selector arm 26 when the unit is not mounted to wall 12.

Mounting holes 74 and 76 provided in front wall segments 70 and 72 of casing 54 receive mounting screws 78 and 80 for extending through registering holes 16 and 18 on base plate 14 to mount the assembly to wall 12. The interior surfaces of wall segments 70 and 72 may be formed with integrally molded tubular spacers 82 and 84 registering with mounting holes 70 and 76 and extending between the front wall segments 70 and 72 and face 20 of plate 14 for bearing a compressive load when screws 78 and 80 are tightened thereby preventing fracture of the plastic casing 54 during mounting.

Front portion 56 of casing 54 is formed with sidewalls **62*a* and 64*a* that are extensions of sidewall 62 and 64 of rear portion 58, and with top and bottom walls 86 and 88 that are spaced inwardly from the corresponding top and bottom wall 66 and 68 of the rear portion 58, and with a front wall 90. The dimensions of front portion 56 of casing 54 are selected to permit the receipt, and mounting of an electro-mechanical timer 92** therewithin as best shown in FIG. 3.

Casing 54 may be formed with air circulating holes 91 at a suitable position thereon, such as on sidewalls 62 and 64, to insure the circulation of ambient air about element 22 when the unit is assembled and mounted on wall 12 as shown in FIG. 3.

Timer 92 includes a housing 94 having the general shape of a right parallelepiped, and within which, preassembled, spring recoil timer and electrical switch mechanisms are mounted. Electrical connection to the contacts of the internal switch mechanism are made by means of terminals 96 and 98 located at the rear of housing 94 (FIG. 3), and the timer is actuated by a rotatable control shaft 100 protruding from a threaded stem 102 that extends from a front wall of housing 94. Timer housing 94 is fitted inside front portion 56 of casing 54, by inserting it through rear opening 60, passing shaft 100 and stem 102 through a centrally located circular opening 104 provided in front wall 90 of casing portion 56. Timer 92 is secured in place by a nut 106 threaded onto a stem 102 from the front wall 90 of casing 54. A manually operated control knob 108 is positioned and secured to shaft 100 for turning the shaft to actuate the timer.

Although any number of switch operated time devices can be utilized, in this embodiment a combined switch and timer mechanism of the spring wind-up, recoil type is employed, in which timer 92 provides an unactuated or expired condition in which the switch contacts associated with terminals 96 and 98 are open, and an actuated or unexpired timing condition in which the internal switch is closed to establish conduction between terminals 96 and 98. A suitable timer is commercially available from M. H. RHODES, INC., which manufactures a timer unit marketed as Model No. 91012. The duration of the actuated timing interval is variable, and is set by rotating shaft 100 via knob 108 by an amount indicated on a time scale 110 of circular format, provided on the exterior face of front wall 90 of casing 54, concentric with knob 108. As indicated by scale 110, the duration of the actuated timing condition is limited to a maximum of five minutes, and in such case knob 108 would be rotated clockwise from the home or zero position shown in FIG. 4, through slightly more than three-quarters of a revolution and thereupon released to commence the timing cycle. For the duration of the timing cycle, the timer switch remains in the actuated condition, electrically connecting terminals 96 and 98.

With reference to FIG. 2, the circuit of the unit when connected to the furnace or other heating apparatus, is shown to include an electrical control 112 which is usually a subassembly mounted on the furnace itself, and from which a pair of control wires 114 and 116 extend to and for connection to the thermostat. Control wires 114 and 116 are responsive to the electrical condition of the thermostat switch contacts to cycle the furnace on and off to achieve a selected range of temperatures established by the selector on the thermostat control unit. In this embodiment, control 112 turns the furnace on when wires 114 and 116 are electrically connected (shorted), while an electrically open condition between wires 114 and 116 turns the furnace off. Output terminals 50 and 51 of unit 11 are connected to wires 114 and 116 so that the electrical condition at terminals 50 and 51 determines the operating state of the furnace. Contacts **24*a* and 24*b* of unit 11 are connected across terminals 50 and 51 and thus across wires 114 and 116 such that as contact 24*a* is moved to close with contact 24*b* in response to the reaction of element 22 to a decreasing ambient temperature, the furnace is turned on. Opening of contacts 24*a* and 24*b*** in reaction to an increasing temperature, turns the furnace off.

The internally mounted switch 118 of timer 92 has its contacts connected via timer terminals 96 and 98 to output terminals 50 and 51, respectively, and thus in parallel with the thermostat contacts **24*a* and 24*b*. When switch 118 is closed by the internal timer mechanism 120 of timer 92, the control 112 of the furnace is dominated by the closed electrical state of the timer switch 118, and the furnace is turned on and maintained on for the duration of the actuated condition of timer 92, irrespective of the operating condition of contacts 24*a* and 24*b*. Thus timer 92 by means of its switch 118 and timer mechanism 120 overrides the thermostatic control of the furnace for the duration of the timed, actuated condition of the timer. At the end of the timing cycle, the control of the furnace by switch 118 self-expires, and thereafter the furnace is controlled in a normal, thermostatic regulated mode by the operation of contacts 24***a* and 24*b* by element 22.

The components of unit 11 are assembled by first attaching leads 122 and 124 to terminals 96 and 98 of timer 92. Next, timer 92 is mounted to casing 54 and the subassemblies of base plate 14 with the standard thermostat control components mounted thereon is moved into proximity with the preassembled timer and casing. Leads 122 and 124 are threaded through apertures 126 and 128 provided on plate 14 adjacent terminals 51 and 50 respectively. Casing 54 is now mounted over plate 14 with the rear extremities of spacers 82 and 84 resting on the front face 20 of plate 14 in registration with mounting holes 16 and 18. The interior surfaces of sidewalls 62 and 64 of casing 54 contacting the exterior sides of plate 14 are now adhesively bonded. Leads 122 and 124 are attached to terminals 51 and 50 at the rear of plate 14 by soldering or other suitable electrical and mechanical securement. When the unit 11 is used in conjunction with a furnace, selector arm 26 will normally be positioned at the lower end of the temperature scale (left-hand side of the scale on panel 30) and in assembling plate 14 and casing 54, it is important to initially dispose arm 26 to the left of spacer 84, inasmuch as spacer 84 obstructs the travel of arm 26 after the unit has been assembled. For other applications, it may be desirable to provide an alternative mounting of casing 54 so as not to obstruct the travel of arm 26.

In using unit 11, it will typically be stocked by realtors, builders or other persons responsible for maintaining and showing vacant houses, apartments or other buildings. For example, in the case of a newly completed, but unsold house, the builder can install unit 11 in place of the standard thermostat, which will subsequently be installed after the house has been sold. During such installation, selector arm 26 will be set for example to a temperature within the range of 40°–60° F., or whatever temperature the builder desires to maintain the premises at, such as to protect the plumbing or to maintain an intermediate temperature from which the house can be quickly heated to a "comfort" level for the benefit of prospective purchasers. This setting is accomplished by inserting a screwdriver or other tool through gap 69 between bottom wall 68 of casing 54 and the bottom of plate 14 as shown in FIG. 3 and shifting end 44 of the arm to the desired position. Next, the control wires 114 and 116 from control 112 (FIGS. 2 and 3) are connected to terminals 50 and 51 at the rear of plate 14 and unit 11 is mounted to wall 12 using screws 78 and 80. With the furnace system turned on, it assumes a normal, thermostatically regulated temperature mode in which the furnace is cycled on and off by thermostat contacts 24*a* and 24*b* to heat the premises to the selected temperature range.

When the house is shown, the salesperson actuates timer 92 by rotating control knob 108, usually to the 5 minute maximum, causing timer switch 118 to override contacts 24*a* and 24*b* and dispose the system in a temporary, unregulated temperature mode in which the furnace is turned and held on, and which will self-expire at the end of the timer's cycle. During this latter mode, it is noted that the temperture of the system is unregulated, and will assume whatever level results from the heat produced by the furnace while it is held on.

It is important to limit the maximum, allowed duration of the actuated condition of timer 92 inasmuch as the furnace is held on and if so operated indefinitely, could at worse, create dangerous overheating of the system, and at best, trigger thermally responsive "overheat" breakers, i.e., devices provided in the furnace itself for shutting down the system when it exceeds certain temperature limits. A maximum duration of five minutes has been found preferable for establishing sufficient time to warm up a typical house (having an average furnace installation) to a comfortable temperature level, such as 70°, when the unit is set for a regulated minimum temperature of 60°. The house will remain at the higher temperature level for approximately 30 minutes, and if the inspection of the house takes longer than this time, the timer 92 can be reactuated, following an intervening period in which the unit has reverted to the thermostatically regulated mode.

Although the 5 minute timer duration is preferred, it is believed that longer maximum intervals can be used, depending on the furnace system, but in no event should the maximum interval exceed 15 minutes otherwise the furnace operation may become dangerous and/or the temperature in the house uncomfortably high.

As usually happens, when the inspection of the house has been completed, the visitors leave without adjusting the thermostat, however since timer 92 self-expires at the end of its cycle, control unit 11 automatically returns to the regulated temperature mode, set at the minimum temperature, thereby avoiding the waste and expense of heating the house at the higher temperature for days and perhaps weeks before the next occupancy.

If it becomes necessary to adjust the selector arm 26, unit 11 is removed from wall 12 to afford access to selector arm 26 through the above-mentioned rear gap 69. Otherwise, when unit 11 is mounted, casing 54 completely surrounds and thus renders the temperature selector "tamper proof", insuring that it will not be turned up to a wasteful temperature level.

While only a particular embodiment of the present invention has been disclosed herein, it will be readily apparent to persons skilled in the art that numerous changes and modifications may be made thereto without departing from the spirit of the invention. For example, a push-button, actuated timer may be provided in lieu of the wind-up, recoil type of timer 92 used in the present embodiment, such that by manually pushing a button, the timer automatically assumes its actuated state for a fixed (nonselectable) timing interval that has been predetermined to provide the necessary amount of heat to increase the room temperature to a comfort level. Similarly, while timer 92 in the present embodiment includes a mechanical timing mechanism, it will be recognized that the timing function can be readily provided by an electrical timing circuit responsive to a manually operated switch, such as the aforementioned pushbutton, and the switch operated by the timer may similarly be an electrical switching circuit rather than the electro-mechanical switch provided here in the form of timer 92.

What is claimed is:

1. In a thermostatically regulated system of the type having an electrically controlled means that can be turned on and off to regulate an ambient temperature in a building, and including a thermostat mounted in such building and having a thermosensitive means for operating electrical contacts between open and closed conditions in response to such ambient temperature, means for setting a predetermined ambient temperature at which said contacts are operated by said thermosensitive means, and output terminal means connected to said contacts for alternately assuming first and second electrical states depending upon said conditions of said contacts, said terminal means adapted for connection to said electrically controlled means for turning such electrically controlled means on when said terminal means are in said first electrical state and for turning such electrically controlled means off when said terminal means are in said second electrical state, an improvement in said thermostat, comprising:

manually actuatable self-expiring timer means having a predetermined maximum timing interval; and electrical override means connected in circuit with said terminal means and responsive to said timer means when actuated to cause said terminal means to assume said first electrical state for the duration of said timing interval, independently of the operation of said electrical contacts by said thermosensitive means, whereby a normal operating made is provided when said timer means is unactuated during which said electrically controlled means is thermostatically regulated to achieve said predetermined ambient temperature and an override mode is provided in response to manual actuation of said timer means for turning the electrically controlled means on for the duration of the timing interval to produce an unregulated temporary change in the ambient temperature.

2. An energy saving control apparatus, for a thermostatically regulated system, interchangeable with a standard thermostat, comprising:

a base plate having front and back faces, a thermosensitive element, electrical contacts operated by said thermosensitive element, and means for setting the temperature at which said contacts are operated by said thermosensitive element, said element, contacts and means all being mounted on said front face of said plate, and electrical control terminals adapted for connection to a control means of a thermostatically regulated system for turning such system on and off depending on the operating state of said contacts;

a hollow casing having a wall portion that defines an opening which is complemental to the perimeter of said base plate and having another wall portion that defines an aperture spaced-apart from said opening, said wall portion that defines said opening being secured to said base plate at said perimeter for conjoint mounting of said base plate and casing to a support surface;

a manually actuated electromechanical timer mounted to said casing and having a body portion provided with electrical timer terminals disposed inside said casing, said timer also having a control member extending through said aperture of said casing for manual operation of said timer between an actuated state and an unactuated state, said timer terminals being electrically connected in circuit with said control terminals, said control terminals being responsive to said contacts and operating in a normal, temperature regulating mode for turning a thermostatically regulated system on and off when said timer is in its unactuated state, and said control terminals being responsive to said timer terminals when said timer is in its actuated state to assume a continuous electrical condition for maintaining such system on independently of the operating state of said contacts, said timer when in its actuated state having a predetermined maximum time interval and at the expiration of such time interval automatically reverting to its unactuated state thereby restoring the control of such system to said contacts.

* * * * *